US005452495A

United States Patent [19]

Briggs

[11] Patent Number: 5,452,495

[45] Date of Patent: Sep. 26, 1995

[54] BRAKE SYSTEM FOR WINDOW ASSEMBLY

[76] Inventor: Jeffrey M. Briggs, Newark, Ohio

[21] Appl. No.: 73,363

[22] Filed: Jun. 7, 1993

[51] Int. Cl.[6] ..... E05D 13/00

[52] U.S. Cl. ..... 16/193; 49/181

[58] Field of Search ..... 16/193; 49/181

[56] References Cited

U.S. PATENT DOCUMENTS

| | | | |
|---|---|---|---|
| 3,055,062 | 9/1962 | Peters et al. . | |
| 3,146,501 | 9/1964 | Peters . | |
| 3,184,784 | 5/1965 | Peters . | |
| 3,462,882 | 8/1969 | Brown, Jr. . | |
| 3,842,540 | 10/1974 | Anderson . | |
| 3,844,066 | 10/1974 | Jobes . | |
| 3,867,790 | 2/1975 | Frank . | |
| 4,364,199 | 12/1982 | Johnson et al. . | |
| 4,555,868 | 12/1985 | Mancuso . | |
| 4,590,708 | 5/1986 | Campodonico . | |
| 4,610,108 | 9/1986 | Marshik . | |
| 4,624,073 | 11/1986 | Randall . | |
| 4,644,691 | 2/1987 | Wright | 49/181 |
| 4,683,676 | 8/1987 | Sterner, Jr. | 49/181 |
| 4,718,194 | 1/1988 | FitzGibbon et al. | 49/181 |
| 4,887,389 | 12/1989 | Haltof . | |
| 4,888,915 | 12/1989 | Goldenberg . | |
| 4,914,861 | 4/1990 | May . | |
| 4,922,657 | 5/1990 | Foss . | |
| 4,958,462 | 9/1990 | Cross | 49/181 |
| 5,069,001 | 12/1991 | Makarowski . | |
| 5,077,939 | 1/1992 | Erickson . | |
| 5,096,240 | 3/1992 | Schultz . | |
| 5,231,795 | 8/1993 | Westfall | 49/446 |

FOREIGN PATENT DOCUMENTS 1195186 10/1985 Canada .

*Primary Examiner*—Mark Rosenbaum
*Assistant Examiner*—Chuck Y. Mah
*Attorney, Agent, or Firm*—Ted C. Gillespie; C. Michael Gegenheimer

[57] ABSTRACT

A brake system for a window assembly comprises a track liner having two generally parallel sides defining a pocket, opposed grooves extending along the sides of the track liner, each groove being defined by a flange extending along the track liner, a base mounted for sliding along the track liner, a brake plate connected to the base and mounted for sliding along the track liner, within the grooves, the brake plate being flexibly connected to the base to enable the brake plate to move relative to the base when the brake plate is moving along the groove, a pair of brake shoes connected to the base and mounted for sliding along the track liner, the flange on each side of the track liner being positioned between the brake plate and a brake shoe, and a receiver actuable to urge the brake shoes and brake plate toward each other to grip the flange in a braking action.

14 Claims, 3 Drawing Sheets

BRAKE SYSTEM FOR WINDOW ASSEMBLY

FIELD OF THE INVENTION

This invention pertains to window assemblies in which one or more sash members are slidably mounted into a window frame. More particularly, this invention relates to a brake system for arresting or stopping the movement of a sash that is slidably mounted in a window frame.

BACKGROUND ART

Modern premium windows are designed to be tilted for cleaning. The window is usually configured to fix two points on the window sash to act as a hinge for tilting. Specifically, such windows have a frame which includes track liners, such as a sill liner and a head liner, and means, such as trucks, for enabling the sash to easily slide within the frame.

One of the problems of tilting windows is that once the window tilts out of the plane of the window frame, if the hinge points undesirably slide in the frame, the window may fall out on the homeowner. This problem has been solved by providing a brake for the hinge points, activated by the tilting action of the window. Prior art brakes for these windows are not as foolproof as desired. Typically, the brake involves a cam or other member which is expanded or pushed against the side or bottom of the track liner. This has been known to fail, giving rise to the possibility of a falling window.

Another problem with prior art brakes to be installed in track liners of windows is that in order for the brakes to provide sufficient stopping action when they are engaged, they are oftentimes configured to somewhat inhibit the easy slidability of the sash within the frame when the brakes are not engaged. Preferably, the brakes provide an excellent grip or braking action when engaged, and yet provide no inhibition to the slidability of the frame within the sash while the brake is not engaged.

Another desirable attribute of braking systems for tilting windows is that the system be designed so that the window cannot be tilted until the brake is completely engaged. Many prior art brake systems are designed so that the brake system is actuated by the movement of a lever or by the actual tilting action of the window itself. In such systems, the braking action begins immediately, but is not fully engaged or completed until the full tilting action of the window is completed, or until the full movement of the lever is completed. In such systems, the window can be tilted before the brake is completely engaged, thereby opening up the possibility of a window falling out of the frame.

There is a need for an improved brake system which provides for easy slidability when the brake is not engaged, provides a sure braking action which will not enable any sliding of the window when the brake is engaged, and provides a positive foolproof system which assures that the brake system is completely activated before the sash can be tilted out of the plane of the frame.

STATEMENT OF THE INVENTION

There has now been invented a brake system for a window assembly in which a brake plate is slidably mounted for sliding along a pair of opposed grooves in a track liner. The brake plate is flexibly connected to a base to enable the brake plate to float or easily move relative to the base when the brake plate and base are sliding along the track liner. The grooves on each side of the track liner are defined in part by a flange, and upon engagement of the brake, the brakeplate and a pair of brake shoes are urged towards each other to grip the flange and engage in a breaking action. The flexibility of the connection between the sliding brake plate and the sliding base enables the brake plate to accommodate variations in the groove and thereby slide easily along the groove in the track liner. Also, the gripping action of the brake plate and brake shoes on the flange provides a strong braking action, assuring that the sash will not slide in the track liner while the brake is engaged. This provides an excellent safety feature, especially when considering today's heavier, larger windows.

According to this invention, there is provided a brake system for a window assembly comprising a track liner, having two generally parallel sides defining a pocket, opposed grooves extending along the sides of the track liner, each groove being defined by a flange extending along the track liner, a base mounted for sliding along the track liner, within the pocket, a brake plate connected to the base and mounted for sliding along the track liner, within the grooves, the brake plate being flexibly connected to the base to enable the brake plate to move relative to the base when the brake plate is moving along the groove, a pair of brake shoes connected to the base and mounted for sliding along the track liner, the flange on each side of the track liner being positioned between the brake plate and a brake shoe and a receiver connected to the base and actuable to urge the brake shoes and brake plate toward each other to grip the flange in a braking action.

In one embodiment of the invention, the movement of the brake plate relative to the receiver is vertical movement.

In another embodiment of the invention, the movement of the brake plate relative to the receiver is pitch movement.

In yet another embodiment of the invention, the movement of the brake plate relative to the receiver is yaw movement.

In a specific embodiment of the invention, the receiver comprises a post, and the brake plate has an orifice and is mounted on the post, the diameter of the orifice being sufficiently larger than the diameter of the post to enable the brake plate to move relative to the base when the brake plate is moving along the groove.

In yet another embodiment of the invention, the post is rotatable, where the post is actuable by rotation to urge the brake shoes and brake plate toward each other to grip the flange in a braking action. Preferably, a cam connected to the post is actuable by rotation to urge the brake shoes and brake plate toward each other to grip the flange in a braking action.

DETAILED DESCRIPTION OF THE INVENTION

Figure 1:
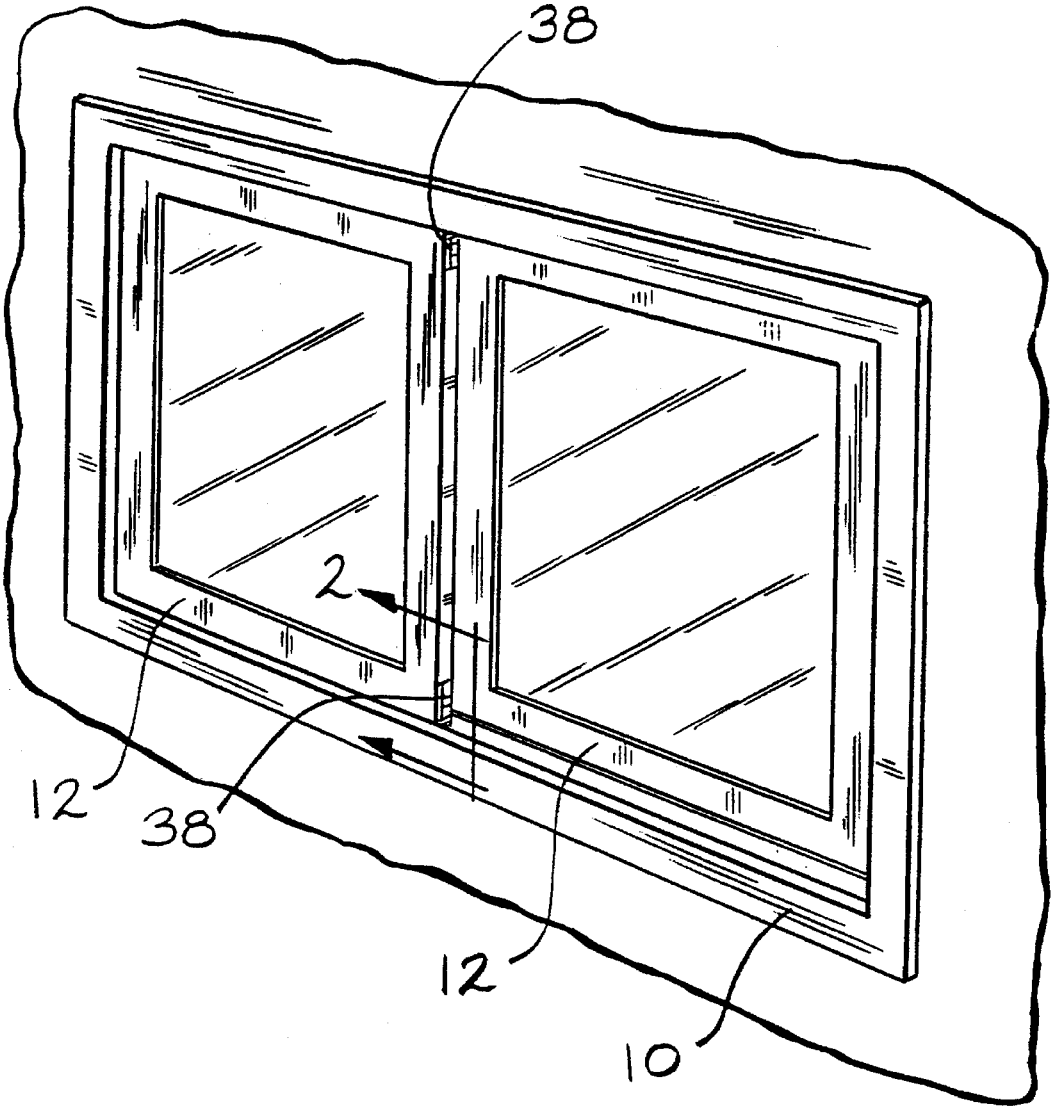
FIG. 1 is a schematic perspective view of a horizontal double sliding window.

As shown in FIG. 1, the window is generally comprised of frame 10 and sashes 12. It is to be understood that the brake system can be used for windows other than the horizontal windows shown in FIG. 1, such as in vertically mounted double-hung windows.

Figure 2:
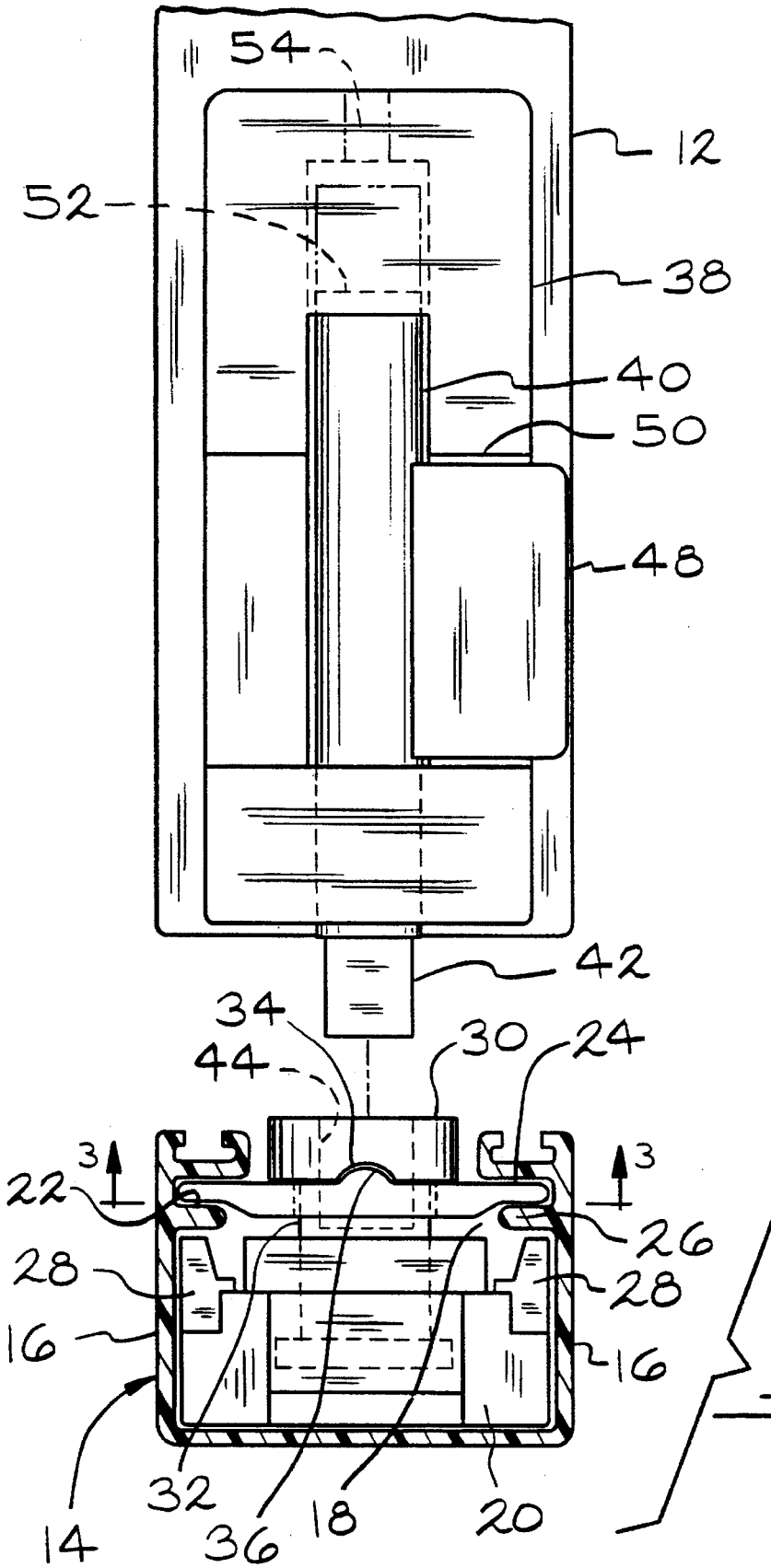
FIG. 2 is a schematic sectional view in elevation along lines 2—2 of the window of FIG. 1.

FIG. 2 shows the sash being vertically separated from track liner 14. This is for purposes of illustration only, and it is to be understood that the sash is not vertically separated from the track liner in actual operation. The track liner is generally comprised of track liner sides 16 which define a concave space or pocket 18. In a horizontally mounted window, as illustrated in FIG. 1, the track liner is a sill liner at the bottom, and a headliner at the top. In vertically mounted windows, such as a double-hung window, the track liners would be jamb liners. Preferably, the track liner is molded plastic, such as vinyl or polyester.

Mounted for sliding movement within the track liner is base 20. The base can be any suitable member for sliding within the track liner, and is suitable for mounting various brake parts and actuators.

The track liner sides are adapted with opposed grooves 22 in which the brake plate 24 is slidably mounted. The grooves extend longitudinally along the length of the track liner. The grooves are defined in part by flanges 26 which extend from the track liner sides into the pocket. The brake plate can be of any suitable material, such as metal.

The base is adapted with a pair of brake shoes 28 which also slide with the base as the base slides within the track liner. Upon actuation of the brakes, the brake plate and the brake shoes are urged toward each other, thereby compressing and gripping the flange in a braking action. The brake shoes can be any suitable member for applying a gripping action to the flange, and preferably have a knurled or otherwise gripping surface to provide good adhesion during a braking action.

The base is adapted with receiver 30 which is actuable to urge the brake shoes and brake plate toward each other to grip the flange in a braking action. Preferably, the receiver comprises a post such as post 32 which is mounted for rotation in the base. Also, preferably, the receiver is adapted with cam detent 34, and the brake plate is adapted with a biasing means, such as cam 36 to press the brake plate downwardly upon the rotation of the receiver. The downward movement of the brake plate engages the flange in a braking action with the brake shoes. The receiver can be any means for receiving the action of a window latch or sash retainer and engaging the brake in response.

As shown in the upper portion of FIG. 2, the sash is adapted with sash retainer 38 which generally provides a release system to enable the sash to be tilted out of the plane of the frame. The sash retainer is generally comprised of bolt 40 which is vertically moved to raise the bolt bottom 42 out of engagement with the receiver. The bolt is mounted for vertical movement within sash retainer slot 46. The receiver is adapted with any suitable means for receiving the bolt bottom, such as key slot 44. It should be understood that ideally there is a sash retainer and receiver in both the top and bottom of the sash.

The bolt bottom, as shown, has a generally rectangular configuration. The bolt bottom matches or is keyed to the key slot in the receiver. When the bolt is rotated 90 degrees, the engagement of the bolt bottom with the key slot causes the receiver to be likewise rotated. This, of course, engages the cam and urges the brake plate toward the brake shoe, thereby providing a braking action on the flange.

In order for the sash to be tilted out of the plane of the frame, the bolt must be raised vertically. In order to provide a failsafe feature of the brake system, the bolt is adapted with a lock, such as bolt flange 48 which rests in bolt flange cutout 50. The flange can be manually gripped to rotate the bolt 90 degrees in order to engage the cam and the brake. The bolt flange rests within the bolt flange cutout and cannot be raised vertically until the 90 degree rotation has occurred. This prevents the bolt from being raised vertically (and thereby enabling the sash to be tilted) without first having a rotation of the receiver and actuation of the brake. The flange is prevented from sliding up into the sash retainer slot unless the rotation has occurred.

Any suitable means for preventing the raising of the bolt prior to the rotation of the bolt can be employed. In an alternative method for ensuring rotation of bolt prior to raising the bolt, the upper end of the bolt 52 can be adapted with a key matching the upper end of the sash retainer slot 54, thereby preventing the raising of the bolt prior to the 90 degree rotation of the bolt in order to line up the keyed end of the bolt with the keyed upper end of the sash retainer slot.

Figure 3:
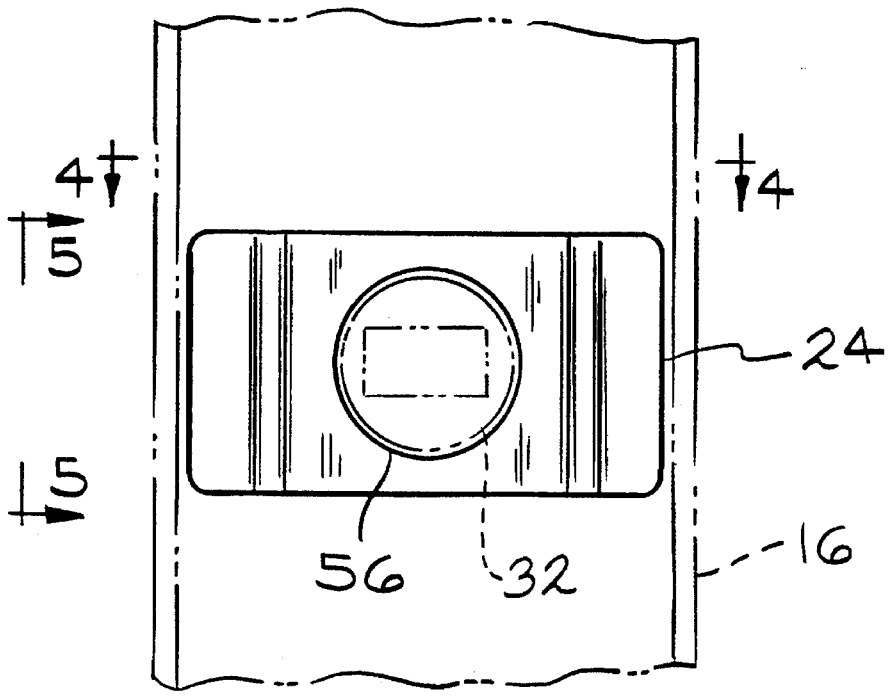
FIG. 3 is a plan view of the brakeplate and post as shown along lines 3—3 of FIG. 2.
Figure 4:
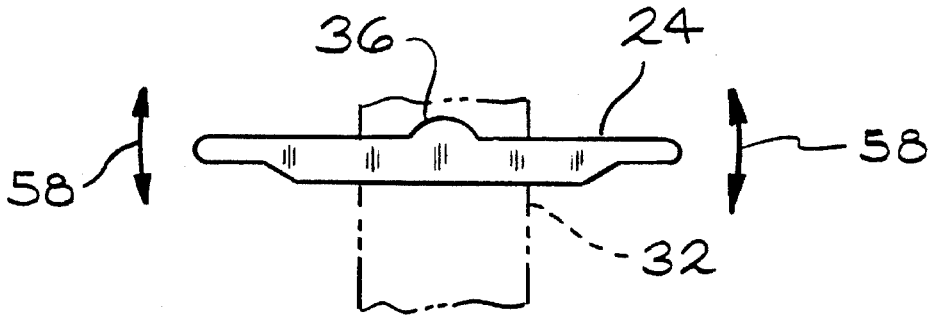
FIG. 4 is a schematic view in elevation of the brake plate and post along lines 4—4 of FIG. 3.

As shown in FIG. 3, the brake plate has orifice 56 and is mounted on the post 32. The diameter of the orifice is sufficiently larger than the diameter of the post to enable the brake plate to float or move relative to the post and base when the brake plate is moving along the track liner. As shown in FIG. 4, the floating feature of the mounting of the brake plate enables the brake plate to tilt sideways, in a yaw movement as shown by arrows 58.

Figure 5:
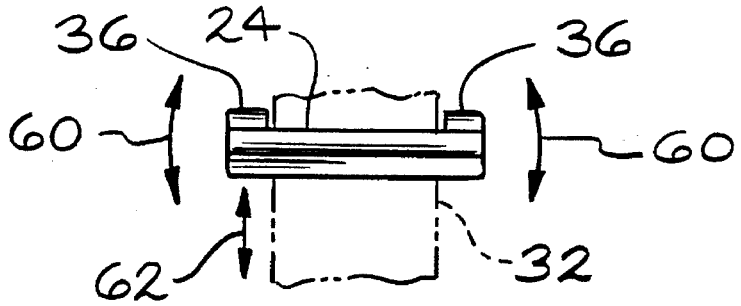
FIG. 5 is a schematic view in elevation of the brake plate and post along lines 5—5 of FIG. 3.

As shown in FIG. 5, the floating feature of the mounting of the brake plate results in a pitch movement, as shown by arrows 60. Also, the brake plate is sufficiently loosely mounted on the post so that the brake plate has a sufficient degree of vertical movement as shown by arrow 62.

It will be understood that various modifications can be made to this invention. Such, however, are considered to be within the scope and spirit of the invention.

I claim:

1. A brake system for a window assembly comprising:

a. a track liner having two generally parallel sides defining a pocket;

b. opposed grooves extending along the sides of the track liner, each groove being defined by a flange extending along the track liner;

c. a base mounted for sliding along the track liner, within the pocket;

d. a brake plate connected to the base and mounted for sliding along the track liner, within the grooves, the brake plate being flexibly connected to the base to enable the brake plate to move relative to the base when the brake plate is moving along the groove, e. a pair of brake shoes connected to the base and mounted for sliding along the track liner, the flange on each side of the track liner being positioned between the brake plate and a brake shoe; and f. a receiver connected to the base and actuable to urge the brake shoes and brake plate toward each other to grip the flange in a braking action, wherein said receiver comprises a post, and the brake plate has an orifice and is mounted on the post, the diameter of the orifice being sufficiently larger than the diameter of the post to enable the brake plate to move relative to the base when the brake plate is moving along the groove.

2. The brake system of claim 1 in which the movement of the brake plate relative to the base is vertical movement.

3. The brake system of claim 1 in which the movement of the brake plate relative to the base is pitch movement.

4. The brake system of claim 1 in which the movement of the brake plate relative to the base is yaw movement.

5. The brake system of claim 1 in which the movement of the brake plate relative to the base is vertical and yaw movement.

6. The brake system of claim 5 in which the movement of the brake plate relative to the base is pitch movement.

7. The brake system of claim 1 in which the post is rotatable, where the post is actuable by rotation to urge the brake shoes and brake plate toward each other to grip the flange in a braking action.

8. The brake system of claim 7 in which the post is adapted with a cam detent and in which the brake plate is adapted with a cam, and the cam is actuable by rotation of the post to urge the brake shoes and brake plate toward each other to grip the flange in a braking action.

9. A brake system for a window assembly comprising:

a. a track liner having two generally parallel sides defining a pocket;

b. opposed grooves extending along the sides of the track liner, each groove being defined by a flange extending along the track liner;

c. a base mounted for sliding along the track liner, within the pocket;

d. a brake plate connected to the base and mounted for sliding along the track liner, within the grooves, the brake plate being flexibly connected to the base to enable the brake plate to move relative to the base when the brake plate is moving along the groove;

e. a pair of brake shoes connected to the base and mounted for sliding along the track liner, the flange on each side of the track liner being positioned between the brake plate and a brake shoe; and, f. a post connected to the base, the post being actuable by rotation to urge the brake shoes and brake plate toward each other to grip the flange in a braking action, where the brake plate has an orifice and is mounted on the post, and the diameter of the orifice is sufficiently larger than the diameter of the post to enable the brake plate to move relative to the base when the brake plate is moving along the groove.

10. The brake system of claim 9 in which the movement of the brake plate relative to the base is vertical movement.

11. The brake system of claim 9 in which the movement of the brake plate relative to the base is pitch movement.

12. The brake system of claim 9 in which the movement of the brake plate relative to the base is yaw movement.

13. The brake system of claim 9 in which the movement of the brake plate relative to the base is vertical and yaw movement.

14. The brake system of claim 13 in which the movement of the brake plate relative to the base is pitch movement.

* * * * *